US009348251B2

(12) United States Patent
Sumikura et al.

(10) Patent No.: US 9,348,251 B2
(45) Date of Patent: May 24, 2016

(54) OPTICAL SCANNING DEVICE AND IMAGE FORMING APPARATUS INCLUDING THE SAME

(71) Applicant: KYOCERA Document Solutions Inc., Osaka (JP)

(72) Inventors: Noriaki Sumikura, Osaka (JP); Kosuke Uchida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/811,405

(22) Filed: Jul. 28, 2015

(65) Prior Publication Data

US 2016/0033890 A1 Feb. 4, 2016

(30) Foreign Application Priority Data

Jul. 29, 2014 (JP) ..... 2014-154011

(51) Int. Cl.
*G03G 15/04* (2006.01)
*G03G 21/00* (2006.01)

(52) U.S. Cl.
CPC ..... *G03G 15/04* (2013.01); *G03G 15/04036* (2013.01); *G03G 21/0005* (2013.01)

(58) Field of Classification Search
CPC combination set(s) only.
See application file for complete search history.

(56) References Cited

U.S. PATENT DOCUMENTS 4,885,466 A * 12/1989 Koichi ..... G03G 15/0291 250/325
5,023,748 A * 6/1991 Okamoto ..... G03G 15/0291 399/100
7,203,444 B2 * 4/2007 Yamazaki ..... H04N 1/00909 347/136
9,115,786 B2 8/2015 Mizuno
2014/0334840 A1 11/2014 Mizuno

FOREIGN PATENT DOCUMENTS

JP 2005-041017 A 2/2005
JP 2009-143108 A 7/2009
WO 2013/115271 8/2013

OTHER PUBLICATIONS

The extended European search report issued by the European Patent Office on Dec. 4, 2015, which corresponds to European Patent Application No. 15178576.3 and is related to U.S. Appl. No. 14/811,450.

* cited by examiner

*Primary Examiner* — Clayton E Laballe
*Assistant Examiner* — Jas Sanghera
(74) *Attorney, Agent, or Firm* — Studebaker & Brackett PC

(57) ABSTRACT

An optical scanning device includes two cleaning holders. The two cleaning holders each include two cleaning members. The two cleaning holders are connected to a wire-shaped member. In accompaniment of circulation of the wire-shaped member, the two cleaning holders travel to cause the cleaning members to slide on corresponding transmissive members. Upon one of the two cleaning holders coming into contact with a first stopper at one end of its travel path, a circulating direction of the wire-shaped member is reversed. Upon the other of the two cleaning holders coming into contact with a second stopper at one end of its travel path, the wire-shaped member stops circulating.

7 Claims, 9 Drawing Sheets

OPTICAL SCANNING DEVICE AND IMAGE FORMING APPARATUS INCLUDING THE SAME

INCORPORATION BY REFERENCE

The present application claims priority under 35 U.S.C. §119 to Japanese Patent Application No. 2014-154011, filed Jul. 29, 2014. The contents of this application are incorporated herein by reference in their entirety.

BACKGROUND

The present disclosure relates to an optical scanning device for forming an electrostatic latent image by irradiating an image bearing member with light in an electrographic image forming apparatus, and an image forming apparatus including such an optical scanning device.

Electrographic image forming apparatuses such as color copiers, color printers, etc. include an optical scanning device. The optical scanning device irradiates a plurality of charged image bearing members with light to form an electrostatic latent image on each of the image bearing members. The optical scanning device includes a casing including an accommodation section having an open end and a covering section that covers the open end. An optical scanning system is built in the interior of the accommodation section. The covering section has an emission port for each of laser beams that each are emitted from the optical scanning system to corresponding one of the image bearing members. Each of the emission ports are covered with a transmissive member. The transmissive members are transmissive to the light (laser beams) emitted from the optical scanning system.

The transmissive members can prevent toner, dust, etc. from entering into the optical scanning device. Attachment of toner, dust, etc. to any of optical components provided in the optical scanning device may cause degradation of optical characteristics. Degradation of the optical characteristics may lead to quality degradation of an image formed on a recording medium such as paper.

In addition, attachment of toner, dust, etc. to an outer surface of one or more of the transmissive members may cause degradation of the optical characteristics. For this reason, it is necessary to periodically clean the outer surface of each of the transmissive members. An image forming apparatus of some type includes an automatic cleaning mechanism that cleans the outer surfaces of the transmissive members automatically. The automatic cleaning mechanism includes screw shafts each extending in terms of the longitudinal direction of the transmissive members. Rotation of each screw shaft moves a plurality of cleaning holders simultaneously in the same direction. Each of the cleaning holders holds a single cleaning member. The cleaning members move along their travel paths to slide on the outer surfaces of the corresponding transmissive members. Thus, the transmissive members are cleaned simultaneously.

SUMMARY

An optical scanning device according to the present disclosure forms electrostatic latent images by irradiating a plurality of image bearing members with laser light. The optical scanning device includes a casing, a plurality of transmissive members, a plurality of cleaning members, a wire-shaped member, a drive section, first and second cleaning holders, and first and second stoppers. The casing has a plurality of emission ports for the laser light. The emission ports are in one-to-one correspondence with the image bearing members. The emission ports extend in a main scanning direction of the laser light. The emission ports are arranged side by side. The transmissive members are transmissive to the laser light. The transmissive members extend in the main scanning direction of the laser light. The transmissive members each close a corresponding one of the emission ports. The cleaning members are in one-to-one correspondence with the transmissive members. The cleaning members each slide on the corresponding transmissive member to clean the corresponding transmissive member. The wire-shaped member is wound in a loop on an outer surface of the casing. The drive section circulates the wire-shaped member in first and second directions. Each of the first and second cleaning holders holds at least two of the cleaning members. When the drive section circulates the wire-shaped member, the first and second cleaning holders travel in mutually opposite travel directions in parallel to a direction in which the transmissive members are extend. The first stopper is located at one end of a travel path of the first cleaning member. Upon the first cleaning holder coming into contact with the first stopper, the first stopper restricts travel of the first cleaning holder in one of the travel directions. The second stopper is located at one end of a travel path of the second cleaning holder. Upon the second cleaning holder coming into contact with the second stopper, the second stopper restricts travel of the second cleaning holder in the one travel direction. When the wire-shaped member is circulated in the first direction, the first cleaning holder travels in the one travel direction and the second cleaning holder travels in the other travel direction. Once the first cleaning holder reaches the one end of the travel path of the first cleaning holder and comes into contact with the first stopper, the drive section switches a circulating direction of the wire-shaped member from the first direction to the second direction. When the wire-shaped member is circulated in the second direction, the first cleaning holder travels in the other travel direction and the second cleaning holder travels in the one travel direction. Once the second cleaning holder reaches the one end of the travel path of the second cleaning holder and comes into contact with the second stopper, the drive section stops circulation of the wire-shaped member.

An image forming apparatus according to the present disclosure includes a plurality of image bearing members and the above optical scanning device. The optical scanning device forms electrostatic latent images by irradiating the image bearing members with light.

DETAILED DESCRIPTION

Figure 1:
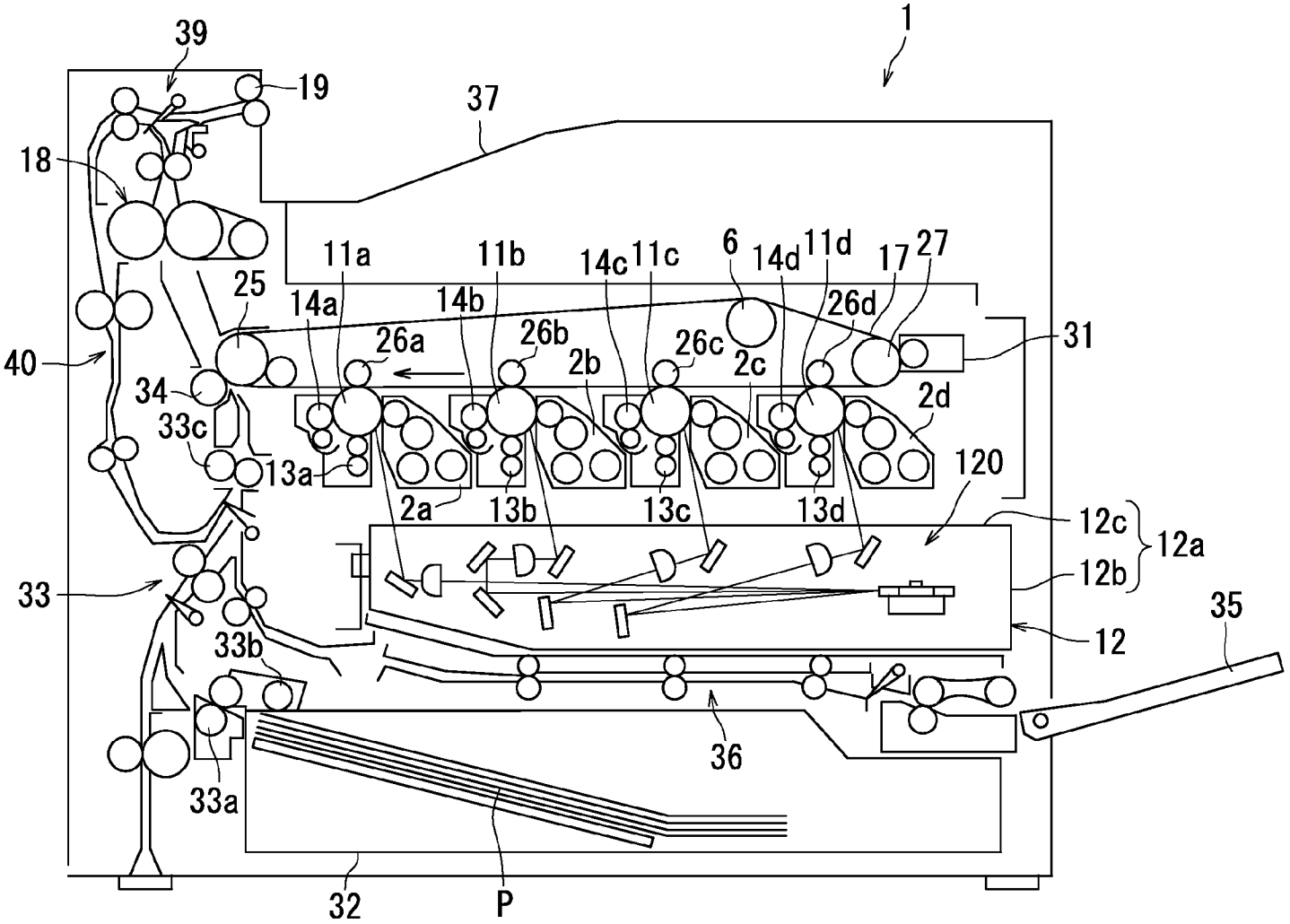
FIG. 1 is a cross sectional view schematically showing an overall configuration of an image forming apparatus according to one embodiment of the present disclosure.

Embodiments of the present disclosure will be described below with reference to the accompanying drawings. Like numerals denote like elements or corresponding elements in the drawings, and repeated description shall be omitted. The drawings are schematic illustrations that emphasize elements of configuration in order to facilitate understanding thereof. Therefore, properties of each of the elements in the drawings, such as thickness and length, may differ from actual properties of the elements for the sake of illustration convenience.

First of all, a configuration of an image forming apparatus 1 according to the present disclosure will be described with reference to FIG. 1. FIG. 1 is a cross sectional view schematically illustrating an overall configuration of the image forming apparatus 1.

The image forming apparatus 1 is a color printer of tandem type. The image forming apparatus 1 includes four photosensitive drums 11*a*-11*d* that are photoreceptors (image bearing members). The photosensitive drums 11*a*-11*d* are rotatable. Each of the photosensitive drums 11*a*-11*d* includes an organic photoreceptor (OPC) having an organic photosensitive layer, an amorphous silicon photoreceptor including an amorphous silicon photosensitive layer, or the like. The four photosensitive drums 11*a*-11*d* are arranged in tandem in one-to-one correspondence with colors of magenta, cyan, yellow, and black.

The photosensitive drum 11*a* is surrounded by a developing device 2*a*, a charger 13*a*, and a cleaning device 14*a*. Similarly, the respective photosensitive drums 11*b*-11*d* are surrounded by respective developing devices 2*b*-2*d*, respective chargers 13*b*-13*d*, and respective cleaning devices 14*b*-14*d*. An optical scanning device 12 is located below the developing devices 2*a*-2*d*. The optical scanning device 12 irradiates the photosensitive drums 11*a*-11*d* with light to form an electrostatic latent image on each of the photosensitive drums 11*a*-11*d*. Note that terms, "above" and "below" in the present specification indicate "up" and "down" in the drawings respectively.

The developing devices 2*a*-2*d* are located left of the photosensitive drums 11*a*-11*d*, respectively. The developing devices 2*a*-2*d* are located opposite to the photosensitive drums 11*a*-11*d* to supply toner to the photosensitive drums 11*a*-11*d*, respectively. Note that terms, "right" and "left" in the present specification indicate "right" and "left" in the drawings, respectively.

The chargers 13*a*-13*d* are arranged upstream of the developing devices 2*a*-2*d* in terms of rotation directions of the photosensitive drums 11*a*-11*d*, respectively. The chargers 13*a*-13*d* are located opposite to the surfaces of the photosensitive drums 11*a*-11*d* to uniformly charge the surfaces of the photosensitive drums 11*a*-11*d*, respectively.

The optical scanning device 12 exposes each of the photosensitive drums 11*a*-11*d* through optical scanning based on image data of a text or a figure input to an image input section from a personal computer or the like. A casing 12*a* of the optical scanning device 12 includes an accommodation section 12*b* having a single open end and a covering section 12*c* that covers the open end. An optical scanning system 120 is disposed in the interior of the accommodation section 12*b*. The covering section 12*c* has an emission port for each of laser beams (laser light) each emitted to a corresponding one of the photosensitive drums 11*a*-11*d* from the optical scanning system 120. Each of the emission ports is covered with a transmissive member, as will be described later with reference to FIG. 2. The transmissive members are transmissive to the light (laser beams) emitted from the optical scanning system 120.

The optical scanning system 120 includes a laser light source (not illustrated) and a polygon mirror. The optical scanning system 120 further includes at least one reflecting mirror and lenses for each of the photosensitive drums 11*a*-11*d*. The respective surfaces of the photosensitive drums 11*a*-11*d* are irradiated with the laser light emitted from the laser light source through the polygon mirror, the reflecting mirrors, and the lenses from downstream of the respective chargers 13*a*-13*d* in terms of rotation directions of the respective photosensitive drums 11*a*-11*d*. An electrostatic latent image is formed on the surface of each of the photosensitive drums 11*a*-11*d* through irradiation of the laser light. The respective developing devices 2*a*-2*d* develop the respective electrostatic latent images into toner images.

An endless intermediate transfer belt 17 is wound around a tension roller 6, a drive roller 25, and a driven roller 27. The drive roller 25 is driven by a motor (not illustrated). The intermediate transfer belt 17 is circulated by rotation of the drive roller 25.

The four photosensitive drums 11*a*-11*d* are arranged side by side in terms of a paper conveyance direction (an arrow direction in FIG. 1) below the intermediate transfer belt 17. The photosensitive drums 11*a*-11*d* are in contact with the intermediate transfer belt 17. Four primary transfer rollers 26*a*-26*d* each are located opposite to corresponding one of the four photosensitive drums 11*a*-11*d* with the intermediate transfer belt 17 therebetween. The primary transfer rollers 26*a*-26*d* each are in press contact with the intermediate transfer belt 17 to form a primary transfer portion in combination with a corresponding one of the photosensitive drums 11*a*-11*d*. A toner image is transferred to the intermediate transfer belt 17 in each of the primary transfer portions. Specifically, circulation of the intermediate transfer belt 17 causes the toner images on the respective photosensitive drums 11*a*-11*d* to be sequentially transferred to the intermediate transfer belt 17 with predetermined timing. In this manner, a full color toner image is formed on the surface of the intermediate transfer belt 7. The full color toner image is superposition of toner images in four colors of yellow, magenta, cyan, and black.

A secondary transfer roller 34 is located opposite to the drive roller 25 with the intermediate transfer belt 17 therebetween. The secondary transfer roller 34 is in press contact with the intermediate transfer belt 17 to form a secondary transfer portion in cooperation with the drive roller 25. At the secondary transfer portion, the toner images (the full color toner image formed on the intermediate transfer belt 17) on the surface of the intermediate transfer belt 17 is transferred to paper P (a sheet of paper). After transfer of the toner images, the belt cleaning device 31 cleans the intermediate transfer belt 17 to remove toner remaining on the intermediate transfer belt 17.

A paper feed cassette 32 is disposed in a lower part of the image forming apparatus 1. The paper feed cassette 32 is capable of accommodating plural sheets of paper P. A manual feed stacking tray 35 is disposed right of the paper feed cassette 32. A first paper conveyance path 33 is disposed left of the paper feed cassette 32. Along the first paper conveyance path 33, the paper P fed from the paper feed cassette 32 is conveyed to the secondary transfer portion. A second paper conveyance path 36 is disposed left of the stacking tray 35. Along the second paper conveyance path 36, the paper P fed from the stacking tray 35 is conveyed to the secondary transfer portion. A fixing section 18 and a third paper conveyance path 39 are disposed in an upper left part of the image forming apparatus 1. The fixing section 18 performs fixing on paper P on which an image is formed. Along the third paper conveyance path 39, the paper P subjected to fixing is conveyed to a paper ejecting section 37.

The paper feed cassette 32 is capable of being drawn outside (a side of the obverse surface of FIG. 1) of the main body of the image forming apparatus 1. This can enable replenishment of paper P to the paper feed cassette 32. Paper P accommodated in the paper feed cassette 32 is fed by a pickup roller 33*b* and a separating roller pair 33*a* to the first paper conveyance path 33. In a situation in which plural sheets of paper P are accommodated in the paper feed cassette 32, the paper P is fed to the first paper conveyance path 33 on a sheet-by-sheet basis by the pickup roller 33*b* and the separating roller pair 33*a*.

The first and second paper conveyance paths 33 and 36 are merged together before (upstream of) a registration roller pair 33*c*. The registration roller pair 33*c* conveys the paper P to the secondary transfer portion. The registration roller pair 33*c* determines timing to feed the paper P to the secondary transfer portion so that the toner images (the full color toner image formed on the intermediate transfer belt 17) transferred (primary transfer) to the intermediate transfer belt 17 is transferred (secondary transfer) to the paper P. The secondary transfer roller 34 to which bias potential is applied transfers the toner images on the intermediate transfer belt 17 to the paper P conveyed to the secondary transfer portion. The paper P to which the toner images are transferred is conveyed to the fixing section 18.

The fixing section 18 includes a fixing belt, a fixing roller, a pressure roller, etc. The fixing belt is heated by a heater. The fixing roller is in contact with the inner surface of the fixing belt. The pressure roller is in press contact with the fixing roller with the fixing belt therebetween. The fixing section 18 applies heat and pressure to the paper P to which the toner images are transferred. In this manner, fixing is performed. Subsequent to fixing of the toner images to the paper p in the fixing section 18, the paper P is reversed in a fourth paper conveyance path 40 as necessary. Then, the reverse surface of the paper P undergoes transfer (secondary transfer) of toner images by the secondary transfer roller 34 and fixing of the toner images by the fixing section 18. The paper P to which the toner images are fixed passes through the third paper conveyance path 39 and ejected onto the paper ejecting section 37 by an ejection roller pair 19.

Figure 2:
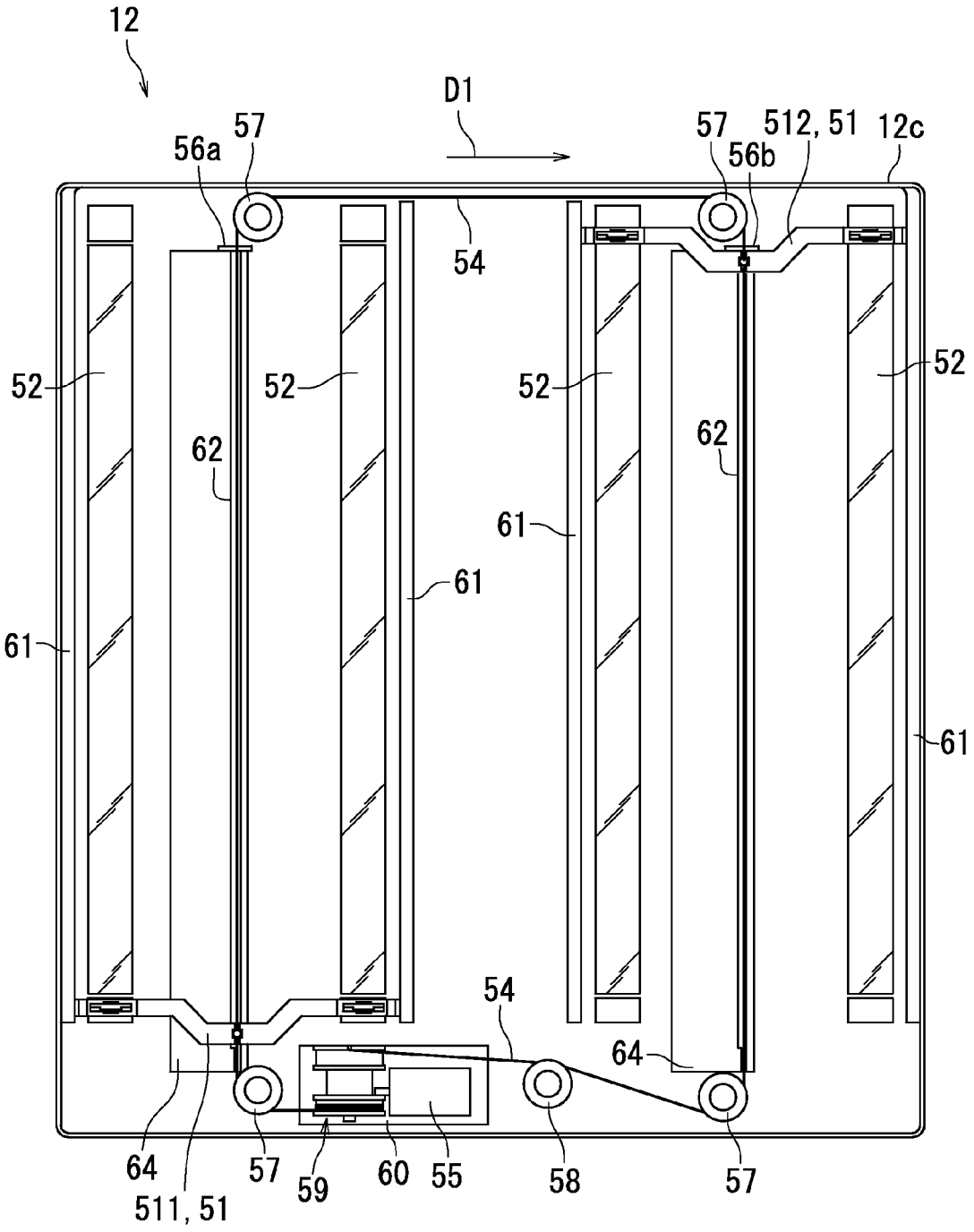
FIG. 2 is a plan view illustrating a covering section of an optical scanning device according to the embodiment of the present disclosure.
Figure 3:
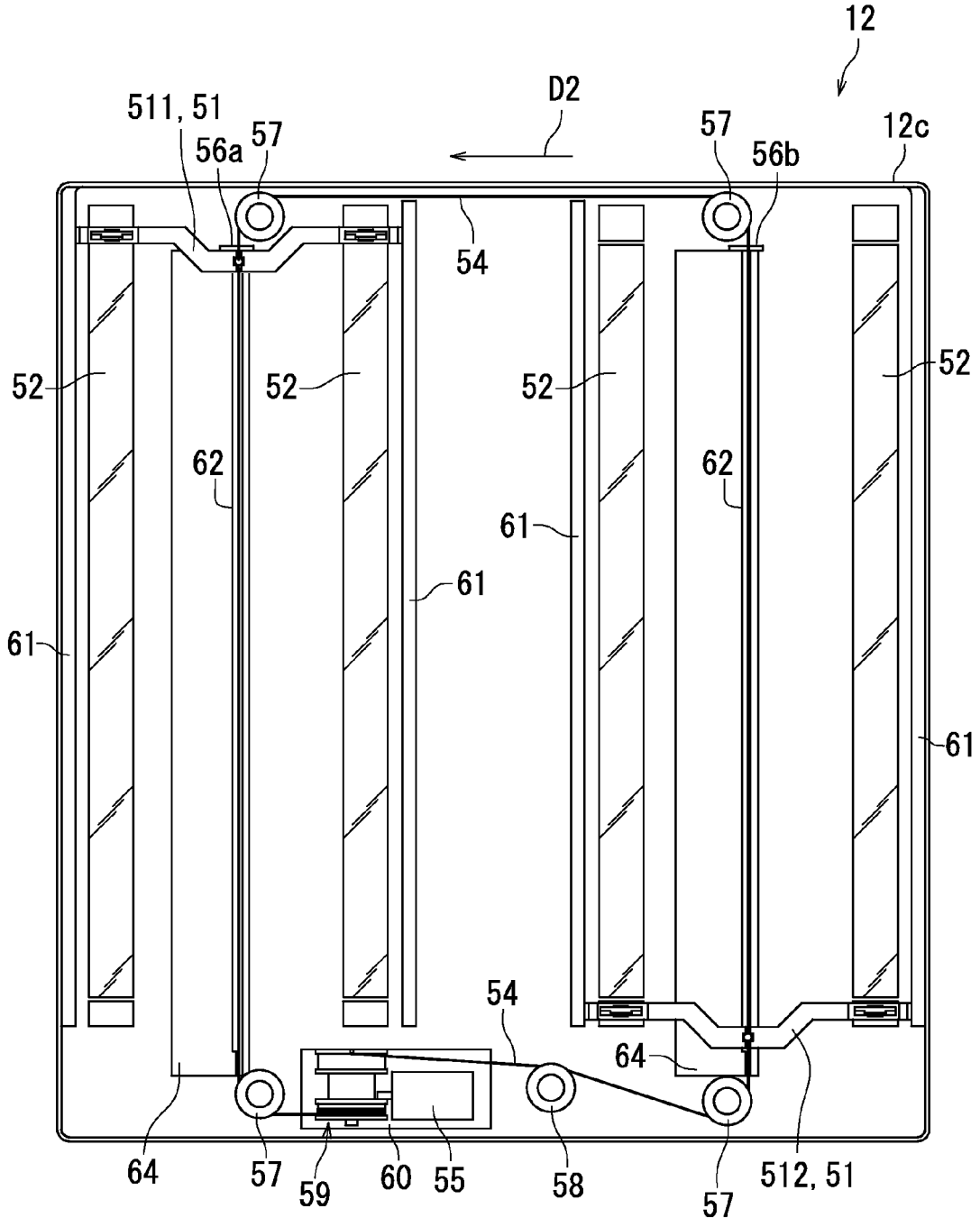
FIG. 3 is a plan view illustrating an operation of cleaning holders located on the covering section according to the embodiment of the present disclosure.
Figure 4:
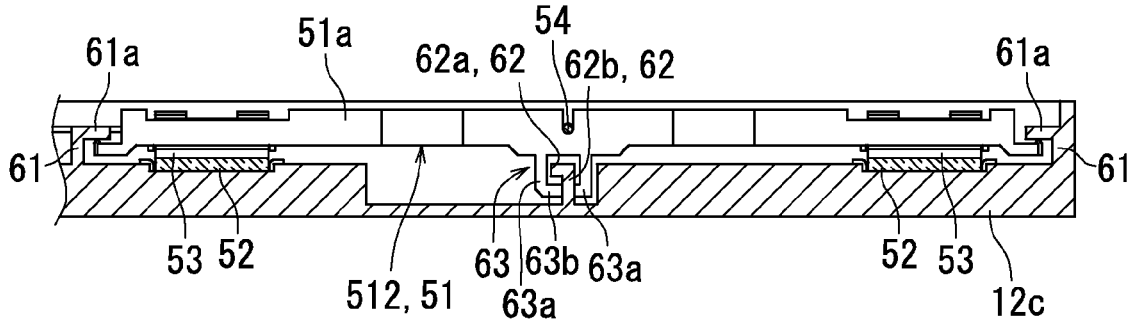
FIG. 4 is a cross sectional view illustrating a portion of the covering section in the embodiment of the present disclosure.

Referring to FIGS. 2, 3, and 4, the optical scanning device 12 will be described next. FIG. 2 is a plan view illustrating the covering section 12*c* of the optical scanning device 12. FIG. 3 is a plan view illustrating an operation of cleaning holders 51 located on the covering section 12*c*. FIG. 4 is a cross sectional view illustrating a portion of the covering section 12*c* when a cleaning holder 51 is viewed from front.

As described above, the casing 12*a* of the optical scanning device 12 includes the accommodation section 12*b* and the covering section 12*c* fitted to the accommodation section 12*b*. The covering section 12*c* has four emission ports each for corresponding one of four laser beams. The four emission ports are arranged side by side in one-to-one correspondence with the four photosensitive drums 11*a*-11*d*. The emission ports each have a rectangular shape extending in the main scanning direction of the corresponding laser light (laser beam) and are arranged in parallel to one another in the longitudinal direction thereof. The emission ports each are closed by a corresponding one of transmissive members 52 each having a rectangular plate shape. The four transmissive members 52 are arranged in parallel to one another in the longitudinal direction thereof. The transmissive members 52 are provided for preventing toner, dust, etc. from entering into the optical scanning device 12. The transmissive members 52 each are a glass cover, for example.

The optical scanning device 12 includes two cleaning holders 51 (first and second cleaning holders 511 and 512).

Each of the cleaning holders 51 includes a holding portion 51*a* (see FIG. 4). The holding portion 51*a* is arranged astride adjacent two transmissive members 52 of the four transmissive members 52 and holds two cleaning members 53. Each of the cleaning holders 51 is located on the outer surface of the covering section 12*c* located on the side of the photosensitive drums 11*a*-11*d*. The two holding portions 51*a* hold the cleaning members 53, four in total, so that the cleaning members 53 each correspond to one of the four transmissive members 52. The cleaning members 53 each are a rubber pad, for example. The rubber pad may be made from silicone rubber, for example. The cleaning holders 51 are made from resin, for example. Note that the cleaning members 53 may be made from nonwoven fabric, for example, rather than the rubber pads.

Each of the cleaning holders 51 is connected to a wire-shaped member 54 wound in a loop. The wire-shaped member 54 is circulated by drive power of a winding motor 55 that is a drive section. Specifically, respective portions of the wire-shaped member 54 runs between left two of the transmissive members 52 and between right two of the transmissive members 52. The wire-shaped member 54 may be a wire, for example.

In accompaniment of circulation of the wire-shaped member 54, the four cleaning members 53 slide on the outer surfaces of the corresponding four transmissive members 52 located on the side of the photosensitive drums 11*a*-11*d*. In this manner, the outer surfaces of the transmissive members 52 are simultaneously cleaned by the corresponding cleaning members 53.

The winding motor 55 is rotatable in both the positive and reverse directions. This can enable repetitive cleaning on the transmissive members 52. In the present embodiment, the winding motor 55 rotates in the positive direction and then in the reverse direction in one time cleaning to reciprocate the cleaning members 53 in a longitudinal direction of the transmissive members 52. Note that the cleaning is performed in response to a user operation on an input device such as a touch panel in a state in which the image forming apparatus 1 is set to a maintenance mode. Alternatively, for example, the cleaning may be performed periodically each time when printing (image formation) is performed about 10000 times.

In the present embodiment, in accompaniment of circulation of the wire-shaped member 54, the two cleaning holders 51 (the first and second cleaning holders 511 and 512) travel linearly in mutually opposite travel directions in parallel to a direction in which the transmissive members extends (the main scanning direction of the laser light). Specifically, the first and second cleaning holders 511 and 512 travel in directions opposite to each other. A first stopper 56*a* is located at one end of a travel path of the first cleaning holder 511. A second stopper 56*b* is located at one end of a travel path of the second cleaning holder 512. The first and second stoppers 56*a* and 56*b* are located on one of sides of the transmissive members 52 in the longitudinal direction of the transmissive members 52. The first stopper 56*a* is located between the left two transmissive members 52. The second stopper 56*b* is located between the right two transmissive members 52. When the first or second cleaning holder 511 or 512 travels to the one end of the corresponding travel path to come in contact with the first or second stopper 56*a* or 56*b*, the wire-shaped member 54 stops circulating. Circulation stop of the wire-shaped member 54 increases a load acting on the winding motor 55 to cause the winding motor 55 to rotate in the reverse direction or stop operating. The first and second stoppers 56*a* and 56*b* may be made from resin, for example. In a case in which the first and second stoppers 56*a* and 56*b* are made of resin, the first and second stoppers 56*a* and 56*b* may be formed integrally with the covering section 12*c*.

With reference to FIGS. 2 and 3, description will be made next about an operation of each of the cleaning holders 51 for one time cleaning. In the present embodiment, the circulation direction of the wire-shaped member 54 is changed from a direction indicated by an arrow D1 (a first direction) to a direction indicated by an arrow D2 (a second direction) in one time cleaning. In the above configuration, as described above, the cleaning members 53 reciprocate one time in the longitudinal direction of the transmissive members 52.

Specifically, once cleaning starts, the wire-shaped member 54 circulates in the first direction indicated by the arrow D1 (see FIG. 2). This configuration causes the first and second cleaning holders 511 and 512 to travel from the respective positions illustrated in FIG. 2 to the respective positions illustrated in FIG. 3, thereby causing the first cleaning holder 511 to come in contact with the first stopper 56*a* at the one end of the corresponding travel path. As a result, the wire-shaped member 54 stops circulating to stop the first and second cleaning holders 511 and 512. In this situation, the load acting on the winding motor 55 increases. In response to the increase in load, the winding motor 55 rotates in the reverse direction to cause the wire-shaped member 54 to circulate in the second direction reverse to the first direction, as indicated by the arrow D2 (see FIG. 3). The first and second cleaning holders 511 and 512 then travel from the respective positions illustrated in FIG. 3 to the respective positions illustrated in FIG. 2, thereby causing the second cleaning holder 512 to come in contact with the second stopper 56*b* at the one end of the corresponding travel path. As a result, the wire-shaped member 54 stops circulating to stop the first and second cleaning holders 511 and 512. In this situation, the load acting on the winding motor 55 increases. In response to the increase in load, the winding motor 55 stops.

In cleaning, the two cleaning members 53 held by the first cleaning holder 511 move in the same direction, while the two cleaning members 53 held by the second cleaning holder 512 also move in the same direction.

The present embodiment can reduce the number of cleaning holders and a required length of the wire-shaped member 54 when compared to the case in which each cleaning holder holds a single cleaning member 53, thereby achieving cost reduction. In other words, in a configuration in which each cleaning holder holds a single cleaning member 53, cleaning holders of which number corresponds to the number of the transmissive members 52 are necessary. This means that more cleaning holders are necessary when compared to the configuration in which the cleaning holders 51 each hold a plurality of cleaning members 53 as in the present embodiment. Further, in the configuration in which each cleaning holder holds a single cleaning member 53, the number of cleaning holders to be connected to the wire-shaped member increases when compared to the configuration in which the cleaning holders 51 each hold a plurality of cleaning members 53 as in the present embodiment. As such, the length of the wire-shaped member is necessary to be longer than a total length of one-way travel distance of each cleaning holder. Therefore, in the configuration in which each cleaning holder holds a single cleaning member 53, it is necessary to lengthen the wire-shaped member 54 when compared to the configuration in which the cleaning holders 51 each hold a plurality of cleaning members 53 as in the present embodiment.

The configuration of the optical scanning device 12 will be described further with reference to FIGS. 2 and 3. In the present embodiment, four tension pulleys 57 are rotatably held on the outer surface of the covering section 12*c*. The four tension pulleys 57 are disposed for winding the wire-shaped member 54 in a predetermined loop fashion for tension application. A tension adjusting pulley 58 is rotatably held on the outer surface of the covering section 12*c*. The wire-shaped member 54 is wound in a loop among the tension pulleys 57 and the tension adjusting pulley 58. Specifically, the wire-shaped member 54 is arranged in parallel to the transmissive members 52 in the longitudinal direction of the transmissive members 52 between the two left transmissive members 52 and between the two right transmissive members 52 through the four tension pulleys 57. The tension adjusting pulley 58 is an example of a tension adjusting mechanism. The tension adjusting pulley 58 adjusts tension applied to the wire-shaped member 54. In the above configuration, the use of the rotatable pulleys 57 and 58 for winding the wire-shaped member 54 in a loop can achieve smooth circulation of the wire-shaped member 54.

The wire-shaped member 54 is wound plural times around a winding drum 59. Rotation of the winding drum 59 by the winding motor 55 causes the wire-shaped member 54 to circulate. The winding motor 55 and the winding drum 59 are disposed within a recess 60 that the covering section 12*c* has. Specifically, the winding drum 59 is rotatably held by the covering section 12*c* in the recess 60. The winding motor 55 is fixed to the covering section 12*c* in the recess 60. Note that the winding motor 55 may be fixed to the accommodation section 12*b*.

The cleaning holders 51 engage with the covering section 12*c* in a movable manner in the longitudinal direction of the transmissive members 52. An example of engagement of the cleaning holders 51 with the covering section 12*c* will be described with reference to FIGS. 2 and 4.

As illustrated in FIGS. 2 and 4, in the present embodiment, two pairs of guide rails 61 each are arranged on the outer surface of the covering section 12*c* for a corresponding one of the two cleaning holders 51. The guide rails 61 are an example of first guide members. Each of the guide rails 61 extends in the longitudinal direction of the transmissive members 52. Opposite end parts of each of the cleaning holders 51 (holding portions 51*a*) engage with a corresponding one of the pairs of guide rails 61. The cleaning holders 51 each are guided by a corresponding one of the pairs of guide rails 61 in the longitudinal direction of the transmissive members 52. Accordingly, the cleaning holders 51 can stably travel in the longitudinal direction of the transmissive members 52.

Each of the guide rails 61 includes a hook portion 61*a* protruding toward a corresponding one of the cleaning holders 51. The hook portions 61*a* extend in the longitudinal direction of the transmissive members 52. The opposite end parts of the holding portion 51*a* of each of the cleaning holders 51 are hooked by the hook portions 61*a* of a corresponding one of the pairs of guide rails 61 in a direction away from the casing 12*a* of the optical scanning device 12 (upward in FIG. 4), thereby restricting upward movement (displacement) of the cleaning holders 51. Further, the hook portions 61*a* can prevent the corresponding cleaning holders 51 from falling off from the covering section 12*c* and securely attach the cleaning members 53 to the corresponding transmissive members 52. Preferably, the hook portions 61*a* each are located such as to be always in contact with a corresponding one of the opposite end parts of the holding portions 51*a* of the respective cleaning holders 51. In the above configuration, the respective cleaning members 53 can be pressed against the respective transmissive members 52. This can enable secure attachment of the respective cleaning members 53 to the respective transmissive members 52.

Furthermore, in the present embodiment, two guide ribs 62 protrude from the outer surface of the covering section 12*c* in one-to-one correspondence with to the two cleaning holders 51. The guide ribs 62 are an example of second guide members. The guide ribs 62 each extend in the longitudinal direction of the transmissive members 52. One of the guide ribs 62 (left guide rib 62) is located between the left two transmissive members 52. The other guide rib 62 (right guide rib 62) is located between the right two transmissive members 52. On the other hand, an engaging portion 63 is located on a lower surface of the holding portion 51*a* of each of the cleaning holders 51. The engaging portions 63 each engage with a corresponding one of the guide ribs 62. In the above configuration, the guide ribs 62 each guide a corresponding one of the cleaning holders 51 in the longitudinal direction of the transmissive members 52. Accordingly, the cleaning holders 51 can stably travel in the longitudinal direction of the transmissive members 52.

Preferably, each of the guide ribs 62 is located closer to the wire-shaped member 54. This can further reduce vibration of the cleaning holders 51 in cleaning. In other words, each of the cleaning holders 51 can travel further stably in the longitudinal direction of the transmissive members 52. More preferably, each of the guide ribs 62 is located directly blow the wire-shaped member 54. This can still further reduce vibration of the cleaning holders 51 in cleaning.

In the present embodiment, the wire-shaped member 54 is connected to an upper part of the holing portion 51*a* of each of the cleaning holders 51. The respective engaging portions 63 are located on lower surfaces of the respective holding portion 51*a* of the cleaning holders 51. In the above configuration, engagement parts between the respective guide ribs 62 and the respective engaging portions 63 can be each arranged directly below a corresponding of one of connection parts between the respective cleaning holders 51 and the wire-shaped member 54.

Moreover, in the present embodiment, each of the engaging portions 63 includes a pair of protrusions 63*a* protruding downward. The guide ribs 62 each are located between a corresponding one of the pair of protrusions 63*a*, as illustrated in FIG. 4. In the above configuration, rightward and leftward movements of the cleaning holders 51 can be restricted. Still further, vibration of the cleaning holders 51 about their axes that extend in the vertical direction can be restricted.

Each of the guide ribs 62 in the present embodiment includes a protrusion 62*b* protruding from the covering section 12*c* and a hook portion 62*a* protruding from a tip end of the protrusion 62*b*. The hook portion 62*a* extends leftward (toward one of sides in a direction in which each holding portion 51*a* extends) from the tip end of the protrusion 62*b*. On the other hand, each of the cleaning holders 51 includes a hook portion 63*b* engaging with the hook portion 62*a* of a corresponding one of the guide ribs 62. The hook portions 63*b* each protrude rightward (toward the other of the sides in the direction in which each holding portion 51*a* extends) from one of the two protrusions 63*a* of a corresponding one of the engaging portions 63. In the above configuration, upward movement of the cleaning holders 51 can be restricted. Further, the cleaning holders 51 can be prevented from falling off from the covering section 12*c*.

In a configuration in which the opposite end parts of the holding portion 51*a* of each of the cleaning holders 51 are always in contact with the hook portions 61*a* of the corresponding one of the pairs of guide rails 61 so that the respective cleaning members 53 are in close contact with the respective transmissive members 52, the cleaning holders 51 may deform into arc shapes (in an upwardly curved fashion). In a situation in which the cleaning holders 51 deform into arc shapes, the cleaning members 53 may come off from the corresponding transmissive members 52 at the central parts of the respective cleaning holders 51. By contrast, in the present embodiment, the covering section 12*c* includes the hook portions 62*a* and each of the cleaning holders 51 includes the hook portion 63*b*. When the cleaning holders 51 deform into arc shapes, the hook portion 63*b* of each of the cleaning holders 51 is hooked at the hook portion 62*a* of a corresponding one of the guide ribs 62 in the direction away from the casing 12*a* of the optical scanning device 12, thereby preventing deformation of the cleaning holders 51 into arc shapes. As a result, the respective cleaning members 53 can be securely attached to the respective transmissive members 52. More preferably, the hook portion 62*a* of each of the guide ribs 62 engages with the hook portion 63*b* of a corresponding one of the cleaning holders 51 (the engaging portions 63) at a level (position in the vertical direction) lower than a level at which the respective transmissive members 52 are located. In the above configuration, deformation of the cleaning holders 51 into arc shapes can be reduced more effectively.

Figure 5:
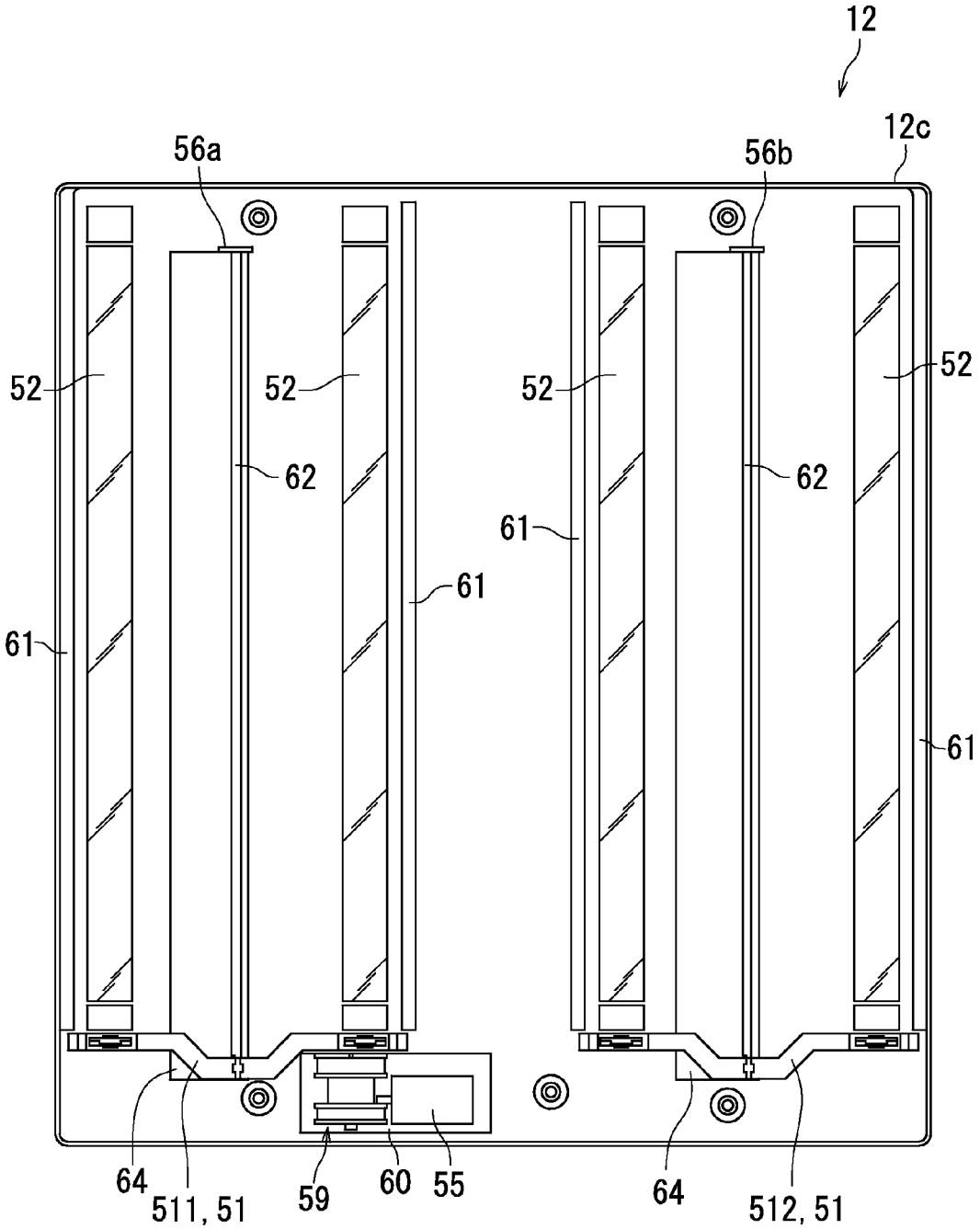
FIG. 5 is a plan view illustrating the covering section before a wire-shaped member is wound according to the embodiment of the present disclosure.
Figure 6:
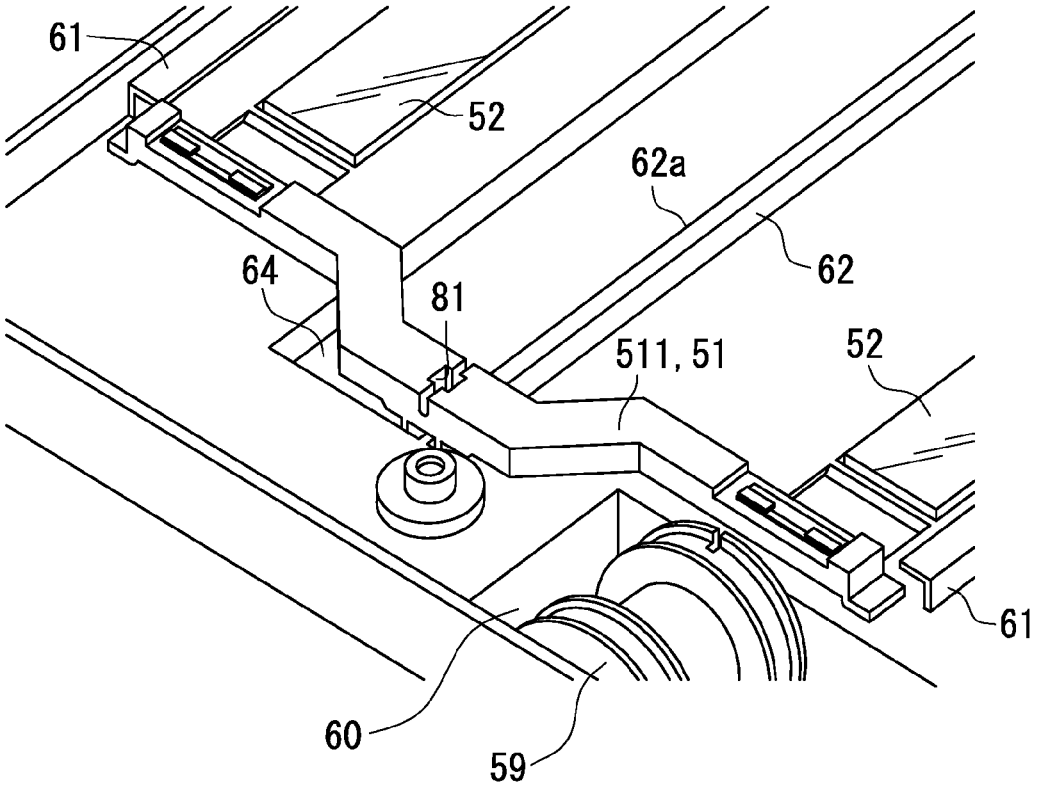
FIG. 6 is an enlarged perspective view illustrating a portion of the covering section according to the embodiment of the present disclosure.
Figure 7:
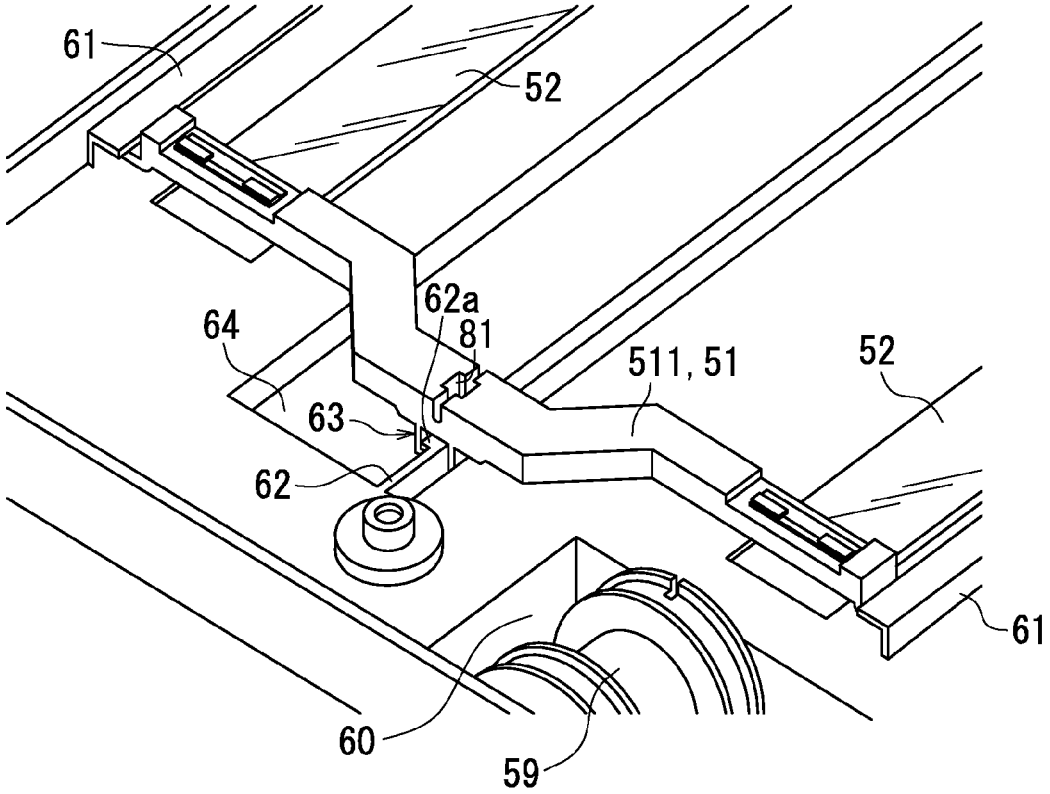
FIG. 7 is an enlarged perspective view illustrating a portion of the covering section according to the embodiment of the present disclosure.

With reference to FIGS. 5, 6, and 7, description will be made about assemblage of the cleaning holders 51 to the casing 12*a* (covering section 12*c*) of the optical scanning device 12. FIG. 5 is a plan view illustrating the covering section 12*c* before the wire-shaped member 54 is wound.

As illustrated in FIG. 5, the covering section 12*c* includes two cleaning holder attachment sections 64. The cleaning holder attachment sections 64 each are a recess through which a corresponding one of the first and second cleaning holders 511 and 512 is attached to and detached from the covering section 12*c* in the present embodiment. The cleaning holders 51 are disposed on the covering section 12*c* so that the engaging portions 63 each are accommodated within a corresponding one of the cleaning holder attachment sections 64 before the wire-shaped member 54 is wound.

As illustrated yet in FIG. 5, one of the two cleaning holder attachment sections 64 is located outside one end of the travel path of the first cleaning holder 511 that is opposite to the side on which the first stopper 56*a* is located. The other cleaning holder attachment section 64 is located outside one end of the travel path of the second cleaning holder 512 that is opposite to the side on which the second stopper 56*b* is located.

FIG. 6 is an enlarged perspective view illustrating a portion of the covering section 12*c* and illustrates a state in which the first cleaning holder 511 is disposed on the covering section 12*c* such that the engaging portion 63 of the first cleaning holder 511 is accommodated in the corresponding cleaning holder attachment section 64 before the wire-shaped member 54 is wound. As illustrated in FIG. 6, in a situation in which the first cleaning holder 511 is disposed on the covering section 12*c* such that the engaging portion 63 of the first cleaning holder 511 is accommodated in the corresponding cleaning holder attachment section 64, the opposite end parts of the holding portion 51*a* of the first cleaning holder 511 do not engage with the corresponding pair of guide rails 61. Similarly, in a situation in which the second cleaning holder 512 is disposed on the covering section 12*c* such that the engaging portion 63 of the second cleaning holder 512 is accommodated in the corresponding cleaning holder attachment section 64, the opposite end parts of the holding portion 51*a* of the second cleaning holder 512 do not engage with the corresponding pair of guide rails 61.

FIG. 7 is an enlarged perspective view illustrating a portion of the covering section 12*c*, and illustrates a state in which the first cleaning holder 511 engages with the corresponding pair of guide rails 61 and the corresponding guide rib 62. As illustrated in FIG. 7, the protrusion 62*b* of the guide rib 62 engaging with the first cleaning holder 511 extends from one end (end on a side of the first stopper 56*a*) of the travel path of the first cleaning holder 511 to a corresponding one of the cleaning holder attachment sections 64 along the corresponding transmissive members 52. Accordingly, the protrusion 62*b* of guide rib 62 engaging with the first cleaning holder 511 is located also in the corresponding cleaning holder attachment section 64. By contrast, the hook portion 62*a* of the guide rib 62 of the first cleaning holder 511 extends from the one end to the other end of the travel path of the first cleaning holder 511 along the corresponding transmissive members 52 but is not located in the corresponding cleaning holder attachment section 64. In the above configuration, as illustrated in FIG. 6, the engaging portion 63 of the first cleaning holder 511 can be easily engaged with the corresponding guide rib 62 by only placing the first cleaning holder 511 on the covering section 12*c* from above. In the same way as above, the engaging portion 63 of the second cleaning holder 512 can be easily engaged with the corresponding guide rib 62 by placing the second cleaning holder 512 on the covering section 12*c* from above.

The pairs of guide rails 61 each extend from the one end to the other end of the travel path of a corresponding one of the cleaning holders 51 in the longitudinal direction of the transmissive members 52 but do not each extend to a region to which a corresponding one of the cleaning holder attachment sections 64 imaginarily extends in a direction in which the transmissive members 52 are arranged (direction perpendicular to the longitudinal direction of the transmissive members 52). In the above configuration, once the first cleaning holder 511 is placed on the covering section 12*c* so that the engaging portion 63 of the first cleaning holder 511 is accommodated in the corresponding cleaning holder attachment section 64 as illustrated in FIG. 6, the first cleaning holder 511 can travel toward the first stopper 56*a* as illustrated in FIG. 7. Thus, the opposite end parts of the holding portion 51*a* of the first cleaning holder 511 can be engaged with the corresponding pair of guide rails 61. In the above situation, the first cleaning holder 511 travels while being guided by the corresponding guide rib 62, so that the opposite end parts of the holding portion 51*a* of the first cleaning holder 511 can be easily engaged with the corresponding pair of guide rails 61. Further in the above situation, the hook portion 63*b* of the first cleaning holder 511 engages with the hook portion 62*a* of the corresponding guide rib 62. In the above configuration, the hook portion 63*b* of the first cleaning holder 511 can be easily engaged with the hook portion 62*a* of the corresponding guide rib 62. In the same way as in the first cleaning holder 511, the second cleaning holder 512 can be easily engaged with the corresponding pair of guide rails 61 and the hook portion 62*a* of the corresponding guide rib 62.

Figure 8:
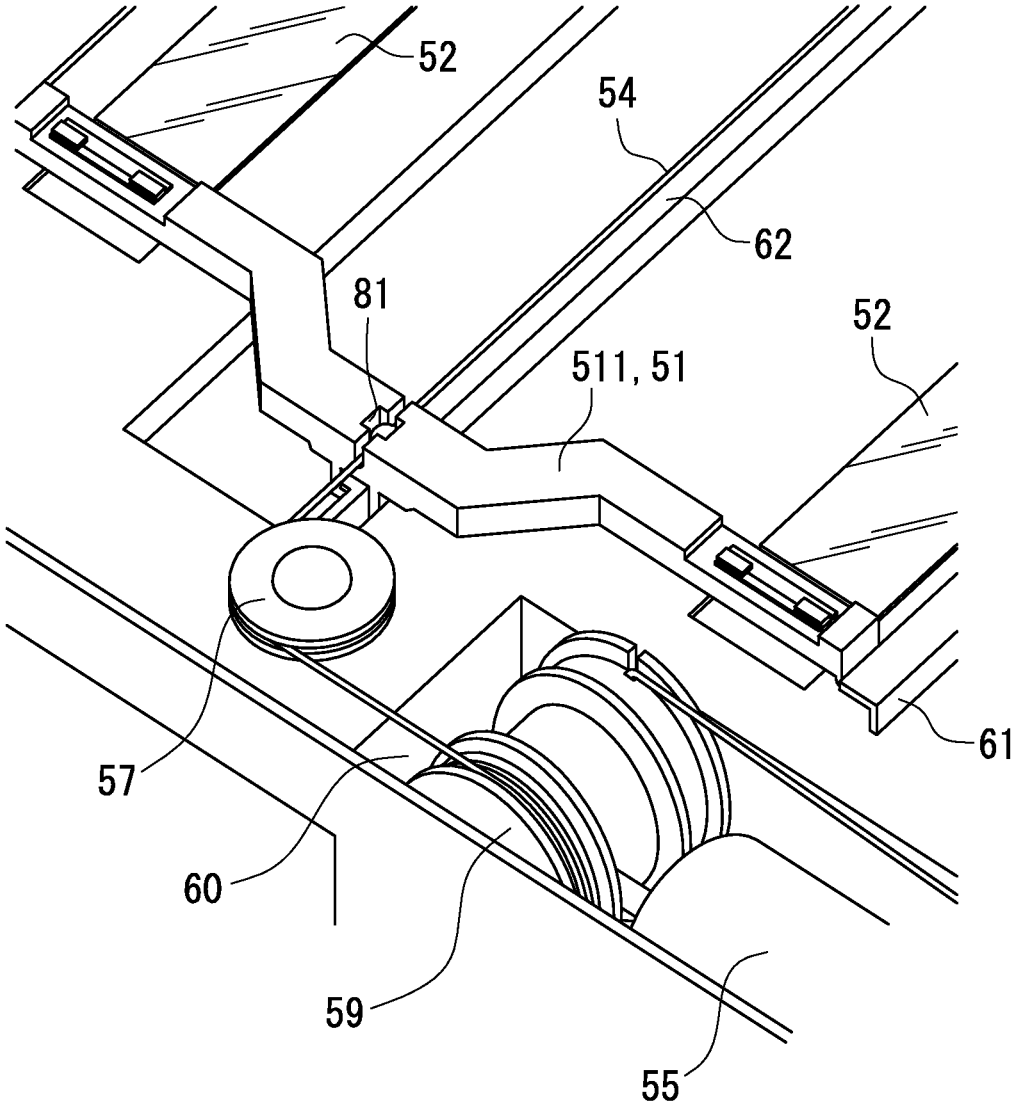
FIG. 8 is an enlarged perspective view illustrating a portion of the covering section according to the embodiment of the present disclosure.
Figure 9:
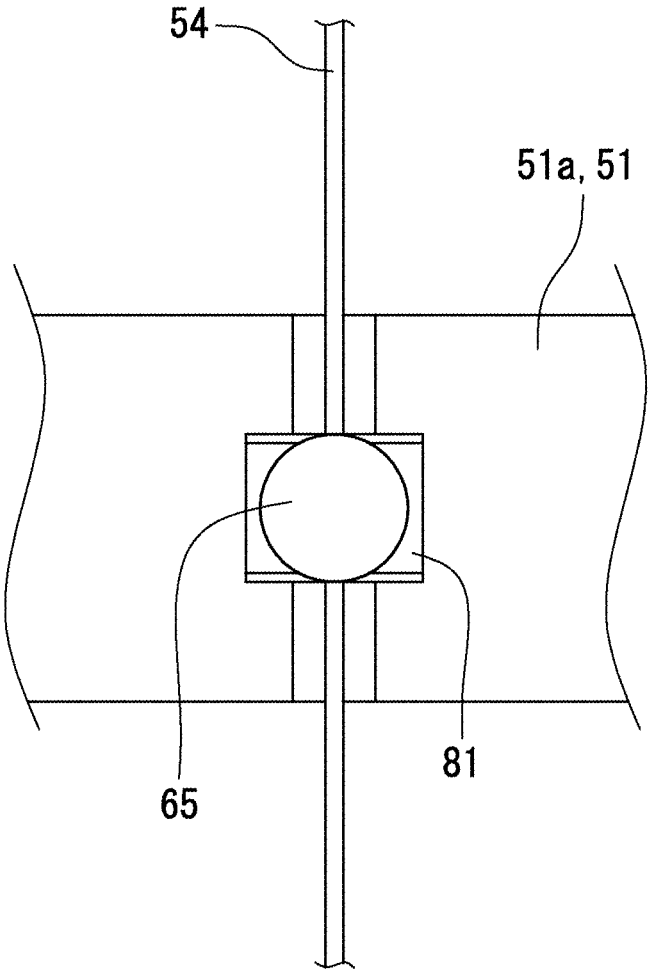
FIG. 9 is an enlarged plan view illustrating a portion of a cleaning holder according to the embodiment of the present disclosure.

An example of a joint mechanism between the cleaning holders 51 and the wire-shaped member 54 will be described with reference to FIGS. 8 and 9. FIG. 8 is a partially enlarged perspective view illustrating the covering section 12*c*. FIG. 9 is a partially enlarged plan view illustrating one of the cleaning holders 51.

In the present embodiment, a spherical joint member 65 is fixed to the wire-shaped member 54 in each of the cleaning holders 51. Each of the cleaning holders 51 has a recess 81 in an upper part of the holding portion 51*a* thereof. The spherical joint member 65 is fitted with play in each of the recesses 81. In the above configuration, each of the cleaning holders 51 is connected to the wire-shaped member 54. The joint members 65 may be swaged and fixed to the wire-shaped member 54, for example. The joint members 65 may be made of resin, for example.

In the above configuration, even when the cleaning holders 51 vibrates to vary in their posture, loads applied from the cleaning holders 51 in the varied posture to the wire-shaped member 54 can be reduced. This can lengthen the lifetime of the wire-shaped member 54.

As described above, the wire-shaped member 54 such as a wire is employed as a member for moving the cleaning holders 51 in the present embodiment. The wire-shaped member 54 has a diameter smaller than a screw shaft usually employed as a member for moving the cleaning members and can accordingly reduce the height of the optical scanning device 12.

Further, the present embodiment provides the first and second stoppers 56*a* and 56*b* at the respective one ends of the travel paths of the first and second cleaning holders 511 and 512. When the first cleaning holder 511 travels to the one end of the corresponding travel path to come into contact with the first stopper 56*a*, the second cleaning holder 512 is located at the other end of the corresponding travel path. In reverse, when the second cleaning holder 512 travels to the one end of the corresponding travel path to come into contact with the second stopper 56*b*, the first cleaning holder 511 is located at the other end of the corresponding travel path. Upon the first cleaning holder 511 coming into contact with the first stopper 56*a*, the winding motor 55 rotates in the reverse direction. Upon the second cleaning holder 512 coming into contact with the second stopper 56*b*, the winding motor 55 stops operating. The above configuration of the present embodiment can eliminate the need to provide stoppers on the both ends of each of the travel paths of the first and second cleaning holders 511 and 512. Therefore, the first and second stoppers 56*a* and 56*b* are located at only corresponding one ends of the travel paths of the first and second cleaning holders 511 and 512. No stopper is disposed at the respective other ends of the travel paths of the first and second cleaning holders 511 and 512. This configuration can enable easy assemblage of the first and second cleaning holders 511 and 512 to the covering section 12*c* from the respective opposite sides to respective sides on which the first and second stoppers 56*a* and 56*b* are located in the respective travel paths of the first and second cleaning holders 511 and 512. Thus, the cleaning mechanism can be easily assembled to the optical scanning device 12.

Furthermore, the respective cleaning holder attachment sections 64 are located outside one end of the travel path of the first cleaning holder 511 that is opposite to the side on which the first stopper 56*a* is located and outside one end of the travel path of the second cleaning holder 512 that is opposite to the side on which the second stopper 56*b* is located. In the above configuration, the cleaning holder attachment sections 64 in the covering section 12*c* can facilitate assemblage of the first and second cleaning holders 511 and 512 to the casing 12*a* of the optical scanning device 12.

The embodiment of the present disclosure has been described in detail so far. However, the present disclosure is not limited to the above embodiment and various alterations can be made to the above embodiment.

For example, the tension pulleys 57 are employed for winding the wire-shaped member 54 in a loop. However, a member for winding the wire-shaped member 54 in a loop is not limited to the pulleys. For example, a plurality of protrusions may be disposed on the outer surface of the covering section 12*c*, rather than the tension pulleys 57, for winding the wire-shaped member 54 to the respective protrusions. Likewise, at least one protrusion may be disposed on the outer surface of the covering section 12*c* in place of the tension adjusting pulley 58 as the tension adjusting mechanism.

Further, only one tension adjusting pulley 58 is provided in the above embodiment, but the number of tension adjusting pulleys may not be limited specifically.

The tension adjusting pulley 58 is arranged as a tension adjusting mechanism for adjusting the tension applied to the wire-shaped member 54 in the above embodiment, but may be omitted.

The winding drum 59 provided in the above embodiment may be omitted.

In the above embodiment, the recording medium is paper (sheet(s) of paper) but may be a substance other than paper such as a resin sheet or fabric.

Moreover, the present embodiment is applied to but is not limited to a tandem color printer and can be applied to any electrographic image forming apparatuses such as color copiers and facsimile machines.

The optical scanning device 12 is disposed below the photosensitive drums 11*a*-11*d* in the above embodiment but may be disposed above the photosensitive drums 11*a*-11*d*.

The properties of each of the elements, such as material and shape thereof described in the above embodiment are mere examples and not limited specifically. A wide range of variations of the properties can be made so long as such variations do not deviate from the intended scope of the present disclosure.

Any other various alterations can be made to the above embodiment within the intended scope not deviating from the present disclosure.

What is claimed is:

1. An optical scanning device for forming electrostatic latent images by irradiating a plurality of image bearing members with laser light, comprising:

a casing having a plurality of emission ports for the laser light that are in one-to-one correspondence with the image bearing members, the emission ports extending in a main scanning direction of the laser light and being arranged side by side;

a plurality of transmissive members that are each configured to close a corresponding one of the emission ports, that are transmissive to the laser light, and that extend in the main scanning direction of the laser light;

a plurality of cleaning members arranged in one-to-one correspondence with the transmissive members and each configured to slide on the corresponding transmissive member to clean the corresponding transmissive member;

a wire-shaped member wound in a loop on an outer surface of the casing;

a drive section configured to circulate the wire-shaped member in first and second directions;

a first cleaning holder and a second cleaning holder that travel in mutually opposite travel directions in parallel to a direction in which the transmissive members extend when the wire-shaped member is circulated by the drive section, each of the first and second cleaning holders holding at least two of the cleaning members;

a first stopper located at one end of a travel path of the first cleaning holder and configured to restrict travel of the first cleaning holder in one of the travel directions upon the first cleaning holder coming into contact with the first stopper; and a second stopper located at one end of a travel path of the second cleaning holder and configured to restrict travel of the second cleaning holder in the one travel direction upon the second cleaning holder coming into contact with the second stopper, wherein when the wire-shaped member is circulated in the first direction, the first cleaning holder travels in the one travel direction while the second cleaning holder travels in the other travel direction, and once the first cleaning holder reaches the one end of the travel path of the first cleaning holder and comes into contact with the first stopper, the drive section switches a circulating direction of the wire-shaped member from the first direction to the second direction, when the wire-shaped member is circulated in the second direction, the first cleaning holder travels in the other travel direction while the second cleaning holder travels in the one travel direction, and once the second cleaning holder reaches the one end of the travel path of the second cleaning holder and comes into contact with the second stopper, the drive section stops circulation of the wire-shaped member, and the casing includes a first cleaning holder attachment section located outside the other end of the travel path of the first cleaning holder and a second cleaning holder attachment section located outside the other end of the travel path of the second cleaning holder, the first and second cleaning holder attachment sections each being a recess through which a corresponding one of the first and second cleaning holders is attached to and detached from the casing.

2. The optical scanning device according to claim 1, wherein the first and second cleaning holders each include a holding portion arranged astride adjacent transmissive members of the transmissive members and holding the at least two of the cleaning members, the casing includes a plurality of first guide members extending in the travel directions, the respective first guide members engage with opposite parts of the respective holding portions, and the respective first guide members guide the first and second cleaning holders in the travel directions and restrict movement of the first and second cleaning holders in a direction away from the casing.

3. The optical scanning device according to claim 2, wherein the first guide members include a guide member extending in the travel directions from the one end to the other end of the travel path of the first cleaning holder and a guide member extending in the travel directions from the one end to the other end of the travel path of the second cleaning holder.

4. The optical scanning device according to claim 2, wherein the first and second cleaning holders each further include an engaging portion protruding from a corresponding one of the holding portions of the first and second cleaning holders, the casing includes a plurality of second guide members each engaging with a corresponding one of the engaging portions of the first and second cleaning holders, and the respective second guide members guide the first and second cleaning holders in the travel directions and restrict movement of the first and second cleaning holders in a direction perpendicular to the travel directions.

5. The optical scanning device according to claim 4, wherein the second guide members each include a protrusion protruding from the casing and a first hook portion protruding from the protrusion, the engaging portions of the first and second cleaning holders each include a pair of protrusions protruding from a corresponding one of the holding portions of the first and second cleaning holders, and a second hook portion protruding from one of the protrusions, the second hook portion protrudes in a direction opposite to a direction in which the first hook portion protrudes, and the second hook portion engages with the first hook portion.

6. The optical scanning device according to claim 5, wherein the protrusion of one of the second guide members that engages with the engaging portion of the first cleaning holder extends in the travel directions from the one end of the travel path of the first cleaning holder to the first cleaning holder attachment section, the protrusion of one of the second guide members that engages with the engaging portion of the second cleaning holder extends in the travel directions from the one end of the travel path of the second cleaning holder to the second cleaning holder attachment section, the first hook portion of one of the second guide members that engages with the second hook portion of the first cleaning holder extends in the travel directions from the one end to the other end of the travel path of the first cleaning holder, and the first hook portion of one of the second guide members that engages with the second hook portion of the second cleaning holder extends in the travel directions from the one end to the other end of the travel path of the second cleaning holder.

7. An image forming apparatus comprising:

a plurality of image bearing members; and the optical scanning device according to claim 1, the optical scanning device being configured to form electrostatic latent images by irradiating the image bearing members with laser light.

* * * * *